United States Patent [19]

Groenendaal, Jr.

[11] Patent Number: 4,826,395

[45] Date of Patent: May 2, 1989

[54] TURBINE INLET FLOW DEFLECTOR AND SEALING SYSTEM

[75] Inventor: John C. Groenendaal, Jr., Winter Springs, Fla.

[73] Assignee: Westinghouse Electric Corp., Pittsburgh, Pa.

[21] Appl. No.: 179,146

[22] Filed: Apr. 8, 1988

[51] Int. Cl.[4] ..... F01D 3/02

[52] U.S. Cl. ..... 415/101; 415/139; 415/173.7

[58] Field of Search ..... 415/93, 99, 101, 103, 415/134, 136, 137, 138, 139, 170 R, 173 R, 174

[56] References Cited

U.S. PATENT DOCUMENTS

| | | | |
|---|---|---|---|
| 3,817,654 | 6/1974 | Sohma | 415/103 |
| 4,764,084 | 8/1988 | Parker et al. | 415/101 |

FOREIGN PATENT DOCUMENTS

| | | | |
|---|---|---|---|
| 101201 | 6/1983 | Japan | 415/103 |
| 859660 | 8/1981 | U.S.S.R. | 415/103 |
| 536238 | 5/1941 | United Kingdom | 415/103 |

*Primary Examiner*—Robert E. Garrett
*Assistant Examiner*—John T. Kwon
*Attorney, Agent, or Firm*—K. Bach

[57] ABSTRACT

A steam turbine having a seal, connected between the annular rows of stationary blades positioned proximate the turbine inlet, for preventing the circumvention of the flow of steam from the desired flow path and for preventing the transfer of thermal loads between the rows of stationary blades. The seal includes a band connected to one of the stationary annular row of blades and extending across the inlet, a support piece connected to the other stationary annular row of blades, and a resilient seal connected to the support piece and positioned to be in frictional engagement with the band.

15 Claims, 3 Drawing Sheets

TURBINE INLET FLOW DEFLECTOR AND SEALING SYSTEM

FIELD OF THE INVENTION

The present invention relates to the field of steam turbines, and more particularly, to the inlet structure of double flow steam turbines for deflecting and directing the flow of steam.

BACKGROUND OF THE INVENTION

In typical double flow steam turbines, a flow of motive steam is provided through an opening in an outer casing to an inlet chamber in an inner casing, whereupon the steam is directed onto a first pair of annular rows of stationary blades positioned on either side of the middle of the turbine. A number of such rows of stationary blades are fixed to the inner casing through attachment, by any one of several known methods, to a blade ring, of which there are several types. A bearing mounted rotor, having a number of annular rows of blades disposed about the periphery of the rotor, is positioned within the inner casing so that the rotor blades are cooperatively associated with the rows of stationary blades. As the motive steam flows and expands from the turbine middle outward, the stationary blades serve to direct the motive steam past the rotor blades to motivate the rotor in a well known manner.

If a portion of the total flow of steam escapes from or otherwise circumvents the above described flow path, the force associated with that portion of steam will not act on the rotor blades, but rather, will be lost. In such situations, the turbine will not be able to achieve maximum efficiency during operation.

In prior double flow steam turbines, steam circumvents its flow path as a result of several necessary gaps between moving and stationary parts. For example, the first annular rows of stationary blades positioned on either side of the turbine inlet typically have inner shroud rings attached to the end of the blades. Each of these shroud rings includes series of strips, wherein each strip is connected to a number of blades. Since the shroud rings are positioned proximate the rotor, there exists a necessary gap to prevent contact with the rotor. Steam passing through this gap will not motivate the rotor as efficiently as if such steam had been directed by a stationary blade onto an annular row of rotor blades.

In attempting to resolve this problem in the past, so-called "belly bands" were incorporated in turbines having a narrow inlet, i.e. from about 5.50 inches to about 8.00 inches in diameter. In such double flow steam turbines the "belly band" was bolted between the ends of shroud rings positioned on either side of the inlet to prevent any steam from passing between the shroud rings. Unfortunately, while this technique stopped the flow of steam it also introduced unwanted turbulence into the flow of steam, reducing turbine efficiency. Another, and perhaps more significant, problem resulting from the use of "belly bands" was the transfer of incompatible loads generated by inner casing thermal expansion. Such loads would be transferred through the band to the shroud rings and the stationary blades. If the incompatibility of such loads, i.e. the difference in load forces, is significant enough the shroud rings, blades, or blade roots may become deformed.

In double flow steam turbines having a wide inlet, i.e. greater than or equal to about 10.00 inches, a structurally complex devices were incorporated in the inlet to prevent the flow of steam from circumventing the desired flow path. This device included a central band which was suspended in the inlet by various structures attached to either the walls of the inlet chamber or to the blade rings. Other band-like structures were attached to the shroud rings positioned on either side of the inlet, so that each band-like structure frictionally engaged an opposite edge of the central band. Such prior devices were not only very costly but also required significant time for installation.

It should also be kept in mind with regard to the circumvention by steam from the desired path that the thermal expansion and/or contraction which occurs can become significant enough to cause ovalized deformation of the ends of the turbine inner casing. Such ovalized deformation can cause portions of the inner casing to which the stationary blades are attached to move away from the rotor, making any existing gap even larger.

Consequently, there is a need for a double flow steam turbine which includes structure for preventing the flow of steam from circumventing the desired flow path and which structure, at the same time, does not contribute additional turbulence to the flow of steam.

SUMMARY OF THE INVENTION

It is an object of the present invention to provide a double flow steam turbine in accordance with the present invention which includes structure for preventing the flow of steam from circumventing the desired flow path.

It is another object of the present invention to provide a double flow steam turbine in accordance with the present invention which minimizes the circumvention by a portion of a flow of steam from a desired flow path and which also minimizes turbulence.

It is another object of the invention to provide a double flow steam turbine in accordance with the present invention which provides structure for sealing the inlet portion of the stator assembly to prevent the circumvention by a portion of a flow of steam from a desired flow path.

It is another object of the invention to provide a double flow steam turbine which provides structure for sealing the inlet portion of the stator assembly to prevent the circumvention by a portion of a flow of steam from a desired flow path and allows for the thermal expansion of internal components.

It is still another object of the present invention to provide a double flow steam turbine which prevents the transfer of thermal loads.

These and other objects of the invention are achieved by a double flow steam turbine having a seal, connected between the annular row of stationary blades positioned proximate the turbine inlet, for preventing the circumvention of the flow of steam from the desired flow path and for preventing the transfer of thermal loads. The seal is shown to include a band connected to one annular row of stationary blades and extending across the inlet, a support piece connected to the oppositely positioned annular row of stationary blades, and a resilient seal connected to the support piece and positioned to be in frictional engagement with the band.

These and other objects and advantages of the invention will become more apparent from the following detailed description when taken in conjunction with the following drawings.

Detailed Description of the Embodiments

Figure 1:
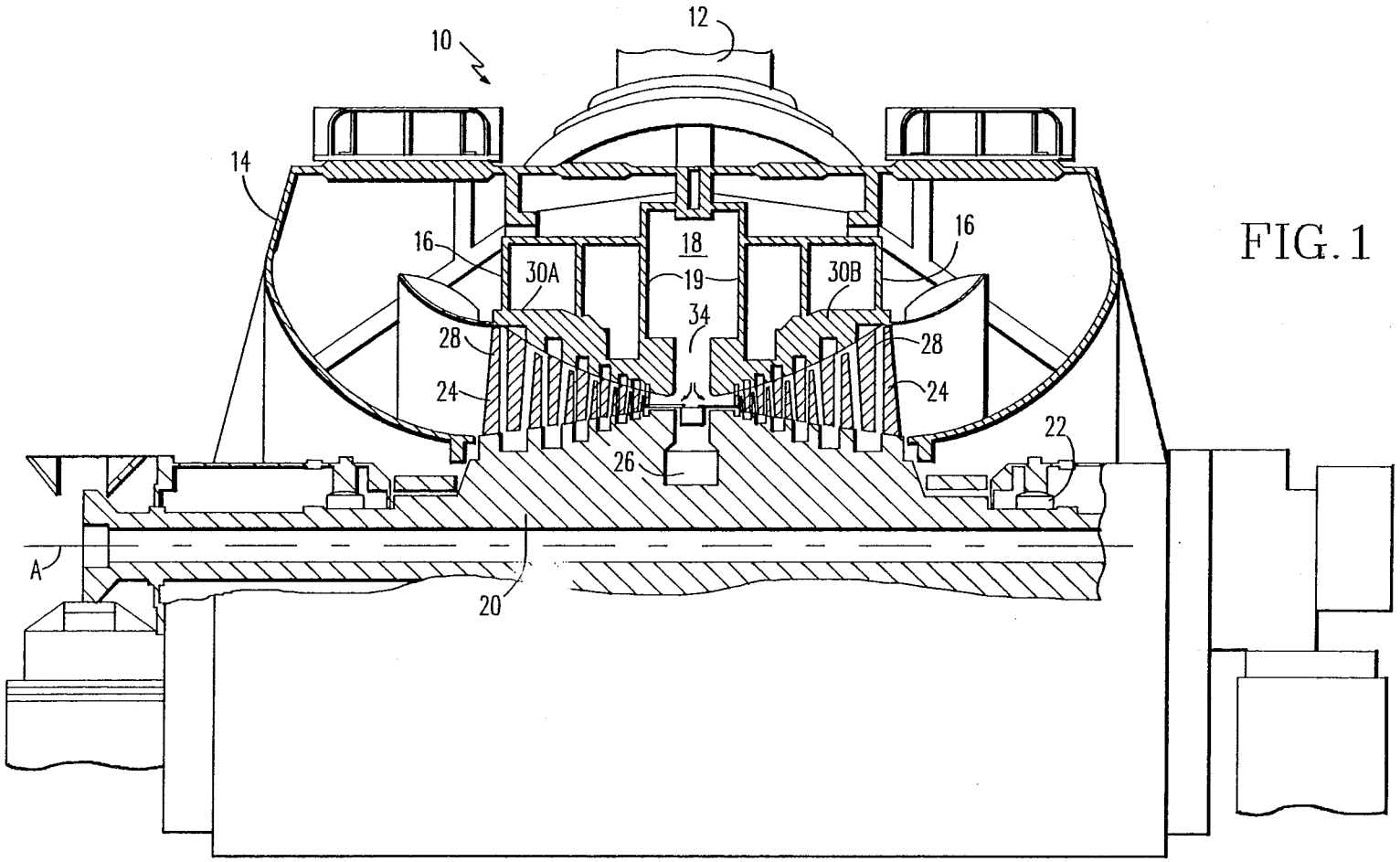
FIG. 1 is a section view of a double flow steam turbine constructed in accordance with the principals of the present invention.

A new and novel double flow low pressure steam turbine constructed in accordance with the principles of the present invention is depicted in FIG. 1 and is generally referred to as 10. Steam from a source (not shown) is supplied to turbine 10 through conduit 12 which is attached to outer casing 14. The flow of steam passes through an opening in the outer casing, through an opening in an inner casing 16, to an inlet chamber 18, which chamber is formed by various central sidewalls 19 in the inner casing. Inner casing 16 is divided into upper and lower halves (not shown) which are joined along a horizontal joint flange in a known manner.

A rotor 20 is mounted in bearings 22 to rotate about an axis of rotation "A". A number of annular rows of radially extending blades 24 are disposed about the periphery of rotor 20. The rows of blades 24 are axially spaced on either side of a rotor midpoint 26. Blades 24 contained in each row are of substantially uniform blade length for a given row. Blade length increases for each row the further that row is axially disposed from rotor midpoint 26.

A stator assembly is arranged about rotor 20 and is shown to include a number of stationary annular rows of blades 28 which are operatively positioned in relation to rotor blades 24 for directing the flow of steam onto rotor blades 24. Stationary blades 28 are positioned through their attachment to blade rings 30*a* and 30*b* which in turn are attached to the inner casing on either side of midpoint 26. As shown in FIG. 1, blade rings 30*a* and 30*b* are shown to be integrally formed with walls of inner casing 16. It should be understood however that any suitable means for attaching the blade rings is acceptable.

Although not shown, it will be understood that the stator assembly is divided into upper and lower halves, which are attached to the upper and lower halves of the inner casing. The attachment of blade rings 30*a* and 30*b* on either side of rotor midpoint 26 is such that an opening or inlet 34 is formed in the stator assembly for directing the flow of steam to midpoint 26.

Figure 2:
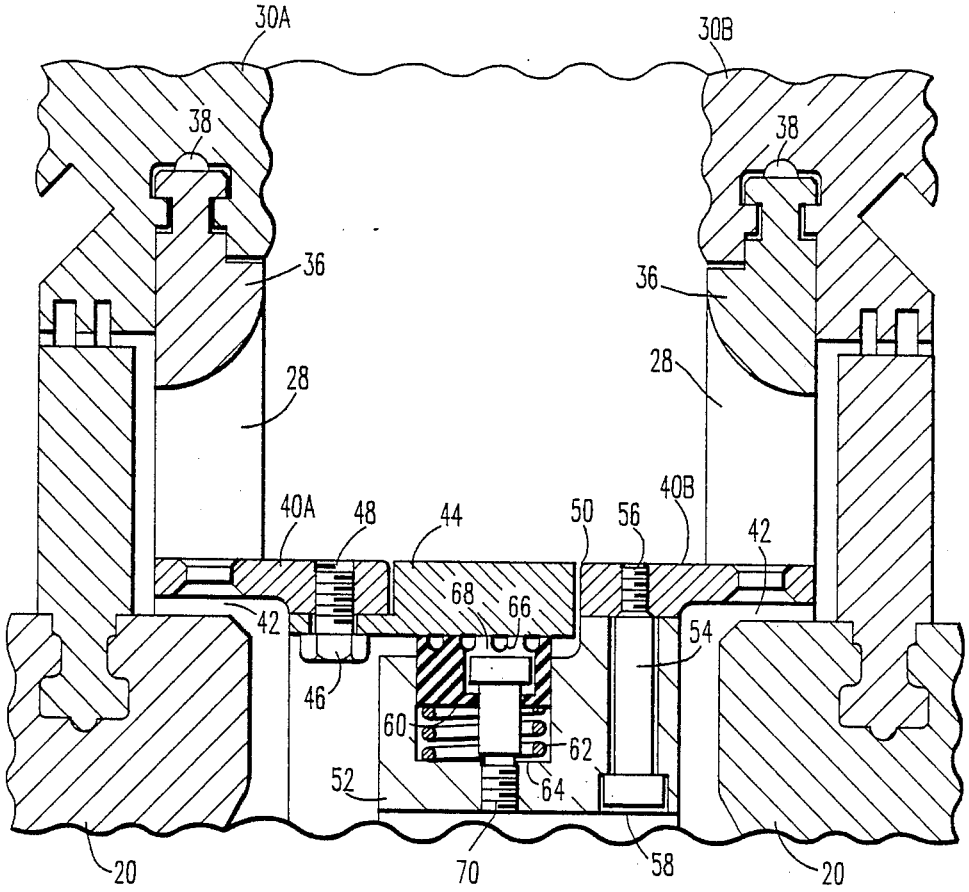
FIG. 2 is an enlarged sectional view of the preferred embodiment of the invention contained in the turbine shown in FIG. 1.

As a flow of steam passes through inlet 34 it is presented to the first rows of stationary blades 28 oppositely positioned on either side of inlet 34. Each blade 28 is shown in FIG. 2 to have a root 36 positioned in corresponding grooves 38. Shroud strips 40*a* and 40*b* are attached to the ends of blades 28 by any known method, which may include rivets or such shroud strips may be integrally formed with blades 28.

In order to prevent contact between shroud strips 40*a* and 40*b* and rotor 20 a gap 42 is provided therebetween. Without providing any further structure, it will be understood that a portion of the flow of steam could escape from or circumvent the desired flow path, i.e. across stationary blades 28, and would instead pass through gap 42. Even if seal strips are placed in the gap, significant levels of steam will still pass therethrough. Since steam passing through gap 42 will not have been given a predetermined direction by stationary blade 28, the efficiency of any motivating effect such non-directed steam will have on blade 24 or rotor 20 will suffer.

As indicated previously, the attachment of a steel band between the shroud strips, positioned on opposite sides of the inlet, can act as a seal, preventing steam from circumventing the desired flow path. However, a major problem with sealing the inlet in this fashion is the transfer of incompatible loads, generated by inner casing thermal expansion, transmitted through the band to the annular rows of stationary blades 28 and shroud strips 40*a* and 40*b*. If the incompatibility of such loads, i.e. the difference in load forces, is significant enough the shroud strips 40*a* and 40*b*, blades 28, roots 36 and the rivets, or other structure used to attach the shroud strips to the blades, may become deformed.

The embodiment shown in FIG. 2, is the preferred embodiment for preventing the circumvention of the steam from the desired flow path across the stationary blades, for deflecting the flow of steam, and at the same time preventing the transfer of thermal loads. As shown in FIG. 2 a sealing band 44 is positioned between shroud strips 40*a* and 40*b* by its attachment only to shroud strip 40*a* by bolts 46 and which band 44 extends a distance across inlet 34. Bolt 46 passes through bore 48 in band 44 and threadingly engages bore 48 formed in shroud strip 40*a*. The top surface of band 44 is shown to be flush with the top surfaces of shroud strips 40*a* and 40*b* so that a minimum amount of turbulence is introduced into the flow of steam. It will be noticed that a gap 50 is formed between the ends of band 44 and shroud strip 40*b*. This gap is to allow for any thermal expansion which may take place as a result of heat being transferred from the flow of steam to those parts of the turbine surrounding inlet 34 which come into contact with the steam.

A support ring 52 is securely attached to shroud strip 40*b* by bolt 54 threadingly engaging bore 56. As can be appreciated from viewing FIG. 2, the head portion of bolt 54 engages a shoulder formed in bore 58 forcing support ring 52 against shroud strip 40*b*. A sealing action, sufficient to prevent the circumvention of the flow of steam from the desired flow path, occurs in this embodiment by biasing resilient seal 60 against the radial inner surface of band 44. Such biasing action results from spring 62 interposed between seal 60 and the bottom of slot 64 formed in support ring 52. Although a coil spring is shown in FIG. 2, it is preferred to use flat so-called "buggy springs" to provide the necessary biasing action to seal 60. It is only necessary that resilient seal 60 be biased with enough force to prevent steam from circumventing the desired flow path and not be biased with such force that axial movement cannot occur between seal 60 and band 44. Such axial movement between seal 60 and band 44 prevents the transfer of thermal loads between stationary blades 28.

Resilient seal 60 is held in place during turbine assembly by bolt 66 passing through bore 68 formed in seal 60 and threadingly engaging bore 70 formed in support piece 52. It will be understood from FIG. 2 that the bottom surface formed by bore 68 engages the head portion of bolt 66 during assembly which engagement is caused by the biasing action of spring 62. Resilient seal 60 is shown to be provided with a number of ridges formed in the surface which frictionally engages band 44.

During operation, the sealing mechanism shown in FIG. 2 deflects the flow of steam onto the first annular rows of stationary blades 28, while at the same time minimizing any turbulence introduced into the flow of steam by such deflection. Since band 60 is only connected to one shroud ring, any thermal expansion or other axial movement which occurs relative to shroud rings 40*a* and 40*b* will not tend to deform the shroud rings. Additionally, since resilient seal 60 is only frictionally engaging band 44, movement of shroud strips 40*a* and 40*b* will not result in the circumvention by the flow of steam from the desired flow path.

Figure 3:
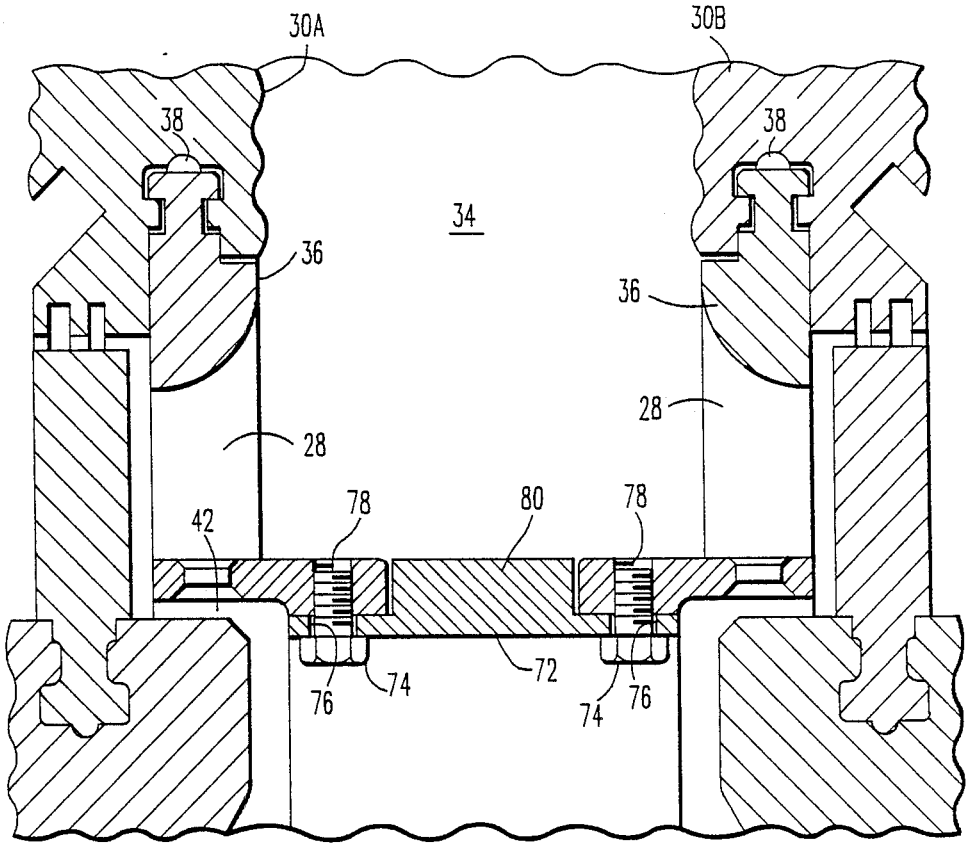
FIG. 3 is an alternate embodiment of the invention from that shown in FIG. 2.

Although not preferred, it may nonetheless be desirable in applications, where the transfer of thermal loads will not be a significant factor, to incorporate structure within the turbine for preventing the circumvention of the flow of steam from the desired flow path which structure statically interconnects shroud strips positioned on opposite sides of the inlet. As shown in FIG. 3 a sealing band 72 is positioned between shroud strips 40*a* and 40*b* and is attached to the radial inner side of such shroud strips by bolts 74. Bolts 74 pass through bores 76 and threadingly engage bores 78 formed in shroud strips 40*a* and 40*b*. Band 72 is provided with a radially raised middle portion 80. The top surface of middle portion 80 is shown to be flush with the top surfaces of shroud strips 40*a* and 40*b*. In this manner, i.e. flush top surfaces, is the introduction of turbulence into the flow of steam avoided.

While the invention has been described and illustrated with reference to specific embodiments, those skilled in the art will recognize that modification and variations may be made without departing from the principles of the invention as described herein above and set forth in the following claims.

For example, instead of a double flow steam turbine, the turbine may be only a single flow steam turbine. In such situations the inlet chamber is positioned at one end of the inner casing. Consequently, one of the inlet chamber sidewalls 19 will also define an end of the inner casing and will not have any blade rings or stationary blades attached thereto. In such a structure support ring 52 or band 72 will attach directly to the sidewall.

What is claimed is:

1. In a double flow steam turbine having a rotor with annular rows of blades disposed about its periphery, a stator assembly, connected about said rotor, having blade rings to which annular rows of stationary blades are fixed, wherein said stator assembly also has an inlet for directing a flow of steam through said inlet and onto said annular rows of stationary blades such movement of said flow of steam constituting a desired flow path, further wherein at least two of said annular rows of stationary blades are positioned on opposite sides of said inlet and operatively positioned in relation to said rotor blades for directing said flow of steam onto said rotor blades, and wherein the transfer of heat from said flow of steam creates thermal loads, apparatus for preventing the decrease in efficiency of said turbine as a result of said flow of steam being directed through said inlet, comprising:

sealing means, connected between said two rows of stationary blades, for preventing the circumvention of said flow of steam from said desired flow path and for preventing the transfer of said thermal loads between said two rows of stationary blades wherein said sealing means comprises, a band attached at one end to one of said two rows of stationary blades and extending a distance across said inlet, a support ring attached to the other of said two rows of stationary blades, and a resilient seal attached to said support ring and frictionally engaging said band so that said flow of steam is prevented from circumventing said desired flow path.

2. The turbine of claim 1, further comprising shroud strips attached to said two rows of stationary blades, said shroud strips having a first top surface which comes into contact with said flow of steam, wherein said band is attached at one end to the shroud strips attached to one of said two rows of stationary blades and wherein said support ring is attached to the shroud strips attached to the other of said two rows of stationary blades, said band having a second top surface which is oriented flush with said first top surface so that the addition of turbulence to said flow of steam due said steam making contact with said band is minimized.

3. The turbine of claim 2, further comprising biasing means, connected between said resilient seal and said support piece, for biasing said resilient seal against said band.

4. The turbine of claim 3, wherein said biasing means comprises a spring.

5. The turbine of claim 1, wherein a gap is provided between the distal end of said band and other of said two rows of stationary blades which allows for thermal expansion.

6. The turbine of claim 1, wherein the surface of said resilient seal which contacts said band comprises a plurality of ridges.

7. The turbine of claim 1, further comprising a restrictor attached to said support piece for maintaining a positional relationship between said resilient seal and said support piece during the assembly of said turbine.

8. The turbine of claim 1, wherein said band has a radially inner side and wherein said resilient seal contacts said radially inner side of said band.

9. The turbine of claim 1, wherein said two rows of stationary blades have shroud strips attached thereto, said shroud strips having a first top surface which comes into contact with said flow of steam, said sealing means comprising, a band connected at one end to one of said shroud strips, said band extending across said inlet chamber and connected to the other of said shroud strips, so that said flow of steam is prevented from passing between said band and said support piece, said band having a second top surface which is flush with said first top surface so that the addition of turbulence to said flow of steam due to said steam making contact with said band is minimized.

10. A steam turbine, comprising:

a rotor having a longitudinal axis of rotation and having at least one annular row of blades disposed about its periphery;

an outer casing, positioned about said rotor, having first inlet means for receiving a flow of steam and outlet means for exhausting said flow of steam;

an inner casing, connected within and to said outer casing and about said rotor, said inner casing having an inlet chamber in fluid communication with said first inlet means for directing said flow of steam, said inlet chamber having sidewalls; a stator assembly, connected within and to said inner casing and about said rotor, including a blade ring connected to one of said sidewalls of said inlet chamber, said blade ring having a stationary annular row of blades attached thereto, said blades wherein said sealing means comprises, a band attached at one end to said shroud strips and extending a distance across said inlet, a support ring attached to another of said inlet chamber sidewalls, and a resilient seal attached to said support ring and frictionally engaging said band so that said flow of steam is prevented from circumventing said desired flow path having shroud strips attached to their ends, said annular row of stationary blades being operatively positioned in relation to said rotor blades for directing said flow of steam, passing through said inlet chamber, onto said annular row of stationary blades such movement of said flow of steam constituting a desired flow path; and sealing means, connected between said shroud strips and one of the sidewalls of said inlet chamber, for preventing the transfer of said thermal loads between said two rows of stationary blades.

11. The turbine of claim 10, wherein said shroud strips have a first top surface which comes into contact with said flow of steam, wherein said band has a second top surface which is oriented flush with said first top surface so that the addition of turbulence to said flow of steam due said steam making contact with said band is minimized.

12. The turbine of claim 11, further comprising biasing means, connected between said resilient seal and said support piece, for biasing said resilient seal against said band.

13. The turbine of claim 12, wherein said biasing means comprises a spring.

14. The turbine of claim 13, wherein the surface of said resilient seal which contacts said band comprises a plurality of ridges.

15. The turbine of claim 10, wherein said sealing means comprises, a band connected at one end to said shroud strips, said band extending across said inlet chamber and connected to one of said sidewalls, so that said flow of steam is prevented from passing between said band and said support piece and wherein said shroud strips have a first top surface which comes into contact with said flow of steam, and wherein said band has a second top surface which is flush with said first top surface so that the addition of turbulence to said flow of steam due to said steam making contact with said band is minimized.

* * * * *